US007151465B2

(12) United States Patent
Barbot et al.

(10) Patent No.: US 7,151,465 B2
(45) Date of Patent: Dec. 19, 2006

(54) METHOD AND APPARATUS FOR TRANSMITTING INFORMATION BETWEEN A SALT-CAVERN AND THE SURFACE OF THE GROUND

(75) Inventors: Jean-Michel Barbot, Beyns (FR); Thierry Pichery, Saint-Martin-du-Tertre (FR); Christian Sirieix, Mezieres-sur-Seine (FR); Bruno Lebriere, Paris (FR); Denis Hafon, Paris (FR)

(73) Assignees: Gaz de France, Paris (FR); Geoservices, Le Blanc-Mesnil (FR)

( * ) Notice: Subject to any disclaimer, the term of this patent is extended or adjusted under 35 U.S.C. 154(b) by 438 days.

(21) Appl. No.: 10/832,207

(22) Filed: Apr. 26, 2004

(65) Prior Publication Data

US 2004/0246140 A1 Dec. 9, 2004

(30) Foreign Application Priority Data

Apr. 30, 2003 (FR) ..... 03 05367

(51) Int. Cl.
*G01V 3/00* (2006.01)

(52) U.S. Cl. ..... 340/854.6; 340/854.9; 403/53

(58) Field of Classification Search ..... 340/853.1, 340/854.6, 855.9, 855.1; 405/52, 53
See application file for complete search history.

(56) References Cited

U.S. PATENT DOCUMENTS 3,400,980 A 9/1968 Dahms et al.
4,161,715 A * 7/1979 Harris ..... 367/86
4,474,053 A * 10/1984 Butler ..... 73/40
5,129,759 A * 7/1992 Bishop ..... 405/59
5,305,828 A * 4/1994 White et al. ..... 166/120
7,080,699 B1 * 7/2006 Lovell et al. ..... 175/40
2006/0150640 A1 * 7/2006 Bishop ..... 62/53.1

FOREIGN PATENT DOCUMENTS

| | | |
|---|---|---|
| EP | 0 314 654 | 5/1989 |
| FR | 2 205 996 | 5/1974 |
| FR | 2 785 017 | 4/2000 |
| WO | WO 94/29749 | 12/1994 |

* cited by examiner

*Primary Examiner*—Timothy Edwards, Jr.
(74) *Attorney, Agent, or Firm*—Weingarten, Schurgin, Gagnebin & Lebovici LLP

(57) ABSTRACT

A method of transmitting information between a salt-cavern and the surface of the ground, the cavern being drilled in geological formation beds and being connected to the surface via an access borehole cased at least in part by metal tubes and presenting at least one safety valve, the method consisting in suspending a string of tools from a hanger system positioned in the access borehole downstream from the safety valve and in electrical contact with the metal tubes, the string of tools including at least one measuring device connected to the hanger system via a first segment of conductor cable and an information transceiver operating by means of waves and connected to the measuring device via a second segment of conductor cable, the transceiver being positioned in such a manner as to be in contact with structural means linked to the cavern; and establishing coupling between the transceiver and the structural means, in order to enable information to be transmitted between the measuring device and the surface by propagating waves via the structural means.

13 Claims, 5 Drawing Sheets

METHOD AND APPARATUS FOR TRANSMITTING INFORMATION BETWEEN A SALT-CAVERN AND THE SURFACE OF THE GROUND

This application claims priority to a French application No. 03 05367 filed Apr. 30, 2003.

BACKGROUND OF THE INVENTION

The present invention relates to the general field of transmitting information from a salt-cavern formed in the ground to the surface. More precisely, the invention relates to transmitting information collected at any height within a salt-cavern while still enabling the cavern to be operated normally (filled, tapped, etc.).

Salt-caverns are generally used for underground storage of hydrocarbons such as natural gas or oil. Such hydrocarbon storage can be necessary for retaining energy availability during a crisis (so-called "strategic" storage) or for making it possible to accommodate seasonal peaks in consumption (so-called "seasonal" storage).

Conventionally, a salt-cavern is obtained by drilling a borehole through geological formation beds (rock salt) and by washing out salt with a flow of fresh water in order to create a cavern of desired shape and volume. A production tube is lowered to the bottom of the cavern to enable it to be filled with hydrocarbon.

When storing natural gas, it is essential to monitor continuously the physical parameters internal to the cavern (pressure, temperature, available volume, etc.) while it is in operation, i.e. throughout the period in which the cavern is being filled, is at rest, or is being tapped. In particular, its internal pressure must remain firstly slightly greater than the pressure of the formation in order to avoid any risk of subsidence and loss of useful volume by salt creep, and secondly below the pressure at which the rock fractures in order to guarantee that the cavern remains leaktight. In addition, the volume of gas contained in the cavern depends strongly on storage pressure, and increasing storage pressure even by only a few millibars can lead to several hundreds of thousands of additional cubic meters of gas being stored. Under such conditions, continuous monitoring of pressure while the cavern is being filled makes it possible to determine accurately the volume of gas to be stored.

At present, these physical parameters are calculated from measurements made at the head of the borehole. However, the information that such measurements can give about the situation at the bottom of the cavern is only approximate, thereby leading to large errors in predicting storage.

It is also known to introduce measurement sensors into the annular space defined between a central operating column and the cylindrical wall of the borehole, which sensors are connected to the surface by electric cables. Nevertheless, that technique can be applied to existing boreholes only after implementing expensive modifications. In addition, such measurements performed in the borehole differ from measurements performed in the cavern.

In order to measure these parameters in the cavern, another solution consists in suspending measurement devices from an electric cable connected to the surface. However, in order to ensure that the cable connecting the measurement devices to the surface is not cut, the valves closing the borehole need to be kept in an open position while measurements are being taken. That solution therefore raises obvious problems of safety, and prevents any tapping operations from being performed since there would be a risk of the cable and the measuring devices being entrained therewith.

OBJECT AND SUMMARY OF THE INVENTION

The present invention thus seeks to mitigate such drawbacks by providing a method and apparatus for transmitting information between a salt-cavern and the surface, enabling information to be obtained from any height within the cavern while also enabling the cavern to be operated normally.

To this end, the invention provides a method of transmitting information between a salt-cavern and the surface of the ground, the cavern being drilled in geological formation beds and being connected to the surface via an access borehole cased at least in part by metal tubes and presenting at least one safety valve, the method consisting in: suspending a string of tools from a hanger system positioned in the access borehole downstream from the safety valve and in electrical contact with the metal tubes, the string of tools including at least one measuring device connected to the hanger system via a first segment of conductor cable and an information transceiver operating by means of waves and connected to the measuring device via a second segment of conductor cable, the transceiver being positioned in such a manner as to be in contact with structural means linked to the cavern; and establishing coupling between the transceiver and the structural means, in order to enable information to be transmitted between the measuring device and the surface by propagating waves via the structural means.

Since the measuring device(s) is/are suspended from the hanger system positioned in the access borehole, it is possible to take measurements at any height within the cavern. The measurements taken within the cavern are therefore reliable. In addition, since the string of tools is suspended downstream from the safety valve, there is no need to open the safety valve in order to take measurements, thus avoiding any safety problem and enabling the cavern to be operated normally. In particular, it is possible to monitor the internal pressure of the cavern continuously throughout the operations of injecting hydrocarbons, thus making it possible to optimize storage volume.

Advantageously, the transceiver is in contact with the bottom of the cavern and operates by electromagnetic waves propagating through geological formation beds. In which case, the coupling between the transceiver and the geological formation beds is electrical coupling that takes place by virtue of the presence of an electrolyte covering the bottom of the cavern. Preferably, the electrolyte is electrically conductive brine present continuously at the bottom of the cavern. Alternatively, the electrolyte may be added to the bottom of the cavern.

In a variant of the invention, the transceiver operates by mechanical waves and its coupling with the structural means is mechanical coupling which takes place by virtue of the presence of a vibrating element coupled to the structural means. The vibrating element may be placed at the bottom of the cavern or it may be coupled to the metal tubes.

The measuring device may be suspended in the cavern at any height or it may be suspended directly in the access borehole. In which case, it is necessary to provide the measurement device with an insulating covering in order to avoid any electrical contact between it and the metal tubes of the access borehole.

Advantageously, the step consisting in suspending the string of tools consists in:

a) connecting a transceiver to a conductor cable;

b) opening a safety valve and anti-blowout shutters of the access borehole;

c) lowering the transceiver down the access borehole to downstream from the safety valve and the anti-blowout shutters;

d) closing the anti-blowout shutters of the access borehole so as to block the conductor cable in order to hold the transceiver in suspension and seal the borehole;

e) cutting the cable upstream from the anti-blowout shutters;

f) connecting at least one measuring device to the conductor cable;

g) repeating steps b) to e) for the measuring device;

h) connecting the hanger system to the conductor cable; and i) repeating steps b) to e) for the hanger system.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
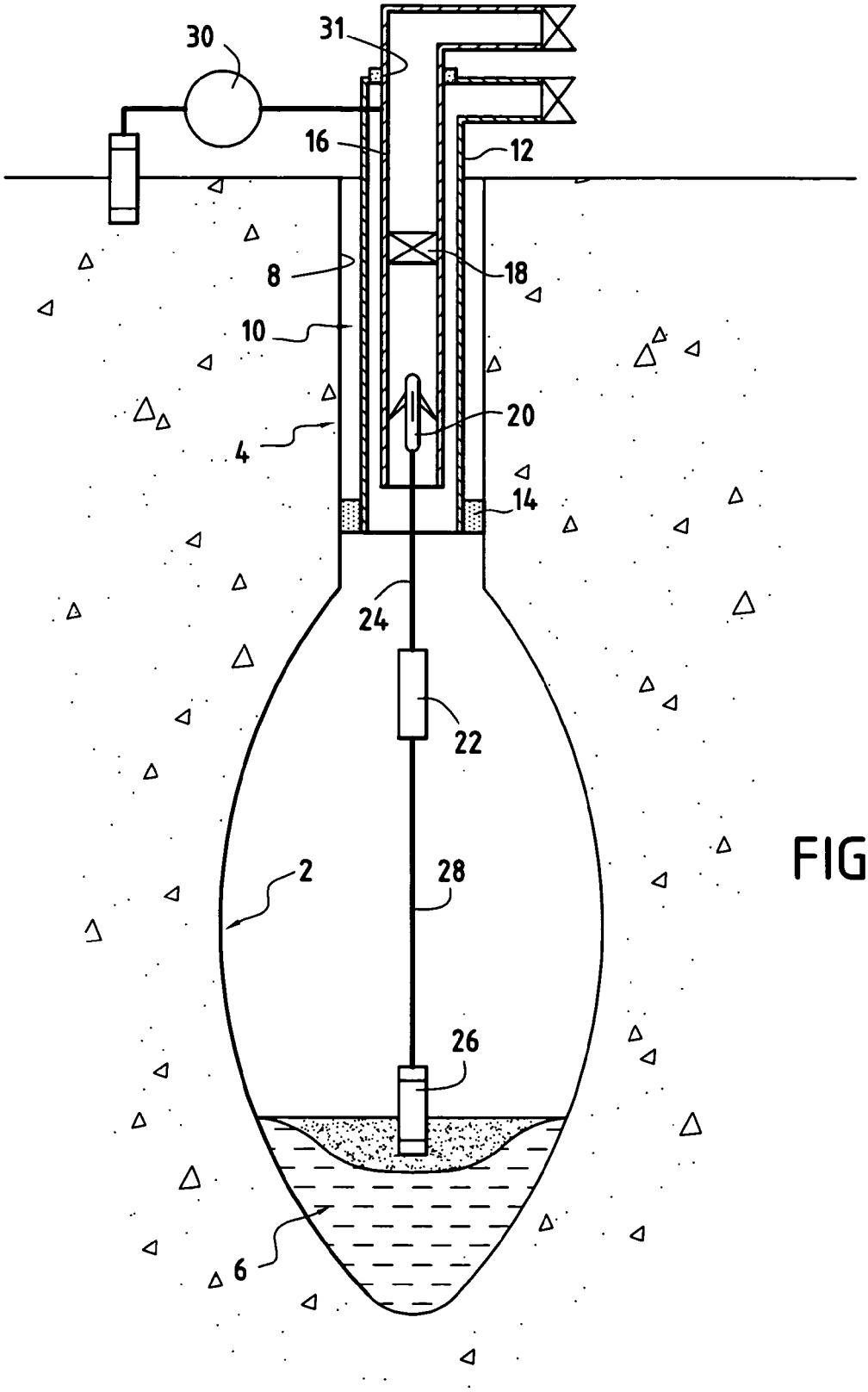
FIG. 1 is a diagram of a salt-cavern provided with apparatus implementing the method of the invention.

FIG. 1 is a section view of a salt-cavern for underground storage of hydrocarbons and presenting apparatus for implementing the method of the invention.

In conventional manner, the salt-cavern 2 is bored through geological formation beds (typically rock salt) and is connected to the surface by an access borehole 4. The cavern is formed by washing out using a flow of fresh water so as to create a cavern of desired shape and volume. At the end of such washing out, a deposit of insoluble material and brine 6 generally covers the bottom of the cavern. The dimensions of the cavern formed in this way are proportional to the desired storage volume. By way of example, the salt-cavern may have a height of more than 200 meters (m).

The access borehole 4 comprises a cylindrical outer wall 8 which defines an annular space 10 that is cemented to a column of casing 12. At the bottom end of the column of casing, a packer device 14 provides sealing between the outside wall of the cavern and the column of casing. A production column 16 known as "tubing" is built up from metal tubes that are lowered inside the column of casing 12 down to the bottom of the salt-cavern so as to enable fresh water to flow that is needed for creating the cavern and also for replacing the brine with the liquid or gas that is to be stored in the underground storage cavern. Once the cavern has been filled, the production column 16 is generally cut off at the roof of the cavern. A safety valve 18 is then placed across the production column so as to enable it to be shut off.

In the method of the invention, a string of tools is suspended within the production column 16 from a hanger system 20. The hanger system 20 is positioned in the production column downstream from the safety valve 18 in a series of steps that are described below.

The hanger system 20 may be a piece of standard equipment made up of at least three arms braced against the inside walls of the production column. Such a hanger system with arms allows operations of injecting hydrocarbons into the cavern to be performed, but it does not allow tapping operations to be performed. The hanger system may also be constituted by a device which is conventionally positioned on a specific seat integrated in the production column, this type of device presenting the advantage over the above type of enabling tapping operations to be performed as well as injection operations.

The hanger system 20 is in electrical contact with the inside walls of the metal tubes of the production column 16 (e.g. via its arms or the seat on which it is positioned). The anchor point for the string of tools can be positioned at any location within the production column that is situated downstream from the safety valve 18.

The string of tools comprises at least one measuring device 22 suspended from the hanger system 20 by a conductor cable 24 so as to provide electrical continuity between the measuring device(s) and the hanger system (only one measuring device is shown in FIG. 1). When a plurality of measuring devices are suspended from the hanger system, they are also connected to one another by conductor cables. The conductor cables may be smooth steel wires, electric cables, or indeed the cables commonly used during slick-line operations in boreholes.

The measuring devices 22 contains logging tools (not shown) that may be pressure sensors, temperature sensors, samplers, flow meters, sonars, etc. They also include means for transmitting and receiving electrical signals, and possibly also a memory enabling the measurements performed by the logging tools to be stored and a power supply battery for these various items of equipment (not shown in the figures).

The string of tools also includes a transceiver 26 which forms an antenna operating by means of electromagnetic waves (radio waves, etc.) or mechanical waves (acoustic waves, seismic waves, etc.). This transceiver is connected to the measuring device 22 via a conductor cable 28 so as to provide electrical continuity between the transceiver and the measuring device so as to enable the electrical signal transmitter and receiver means fitted to the measuring devices to exchange information with the transceiver. The piano-wire type conductor cable that is used is a cable commonly used for slick-line work in boreholes.

Furthermore, the length of the cable 28 is calculated so as to ensure that the transceiver 26 is in contact with stationary structural means associated with the cavern. The structural means may be constituted by the bottom of the cavern, the column of casing 12, or the production column 16. Thus, in FIG. 1, the transceiver 26 is in contact with the deposit of insoluble material and brine 6 covering the bottom of the cavern. In a variant embodiment shown in FIG. 3, the transceiver 26 may be coupled to the bottom portion of the production column 16 or with the bottom portion of the column of casing 12 (in dashed lines in the figure).

Figure 3:
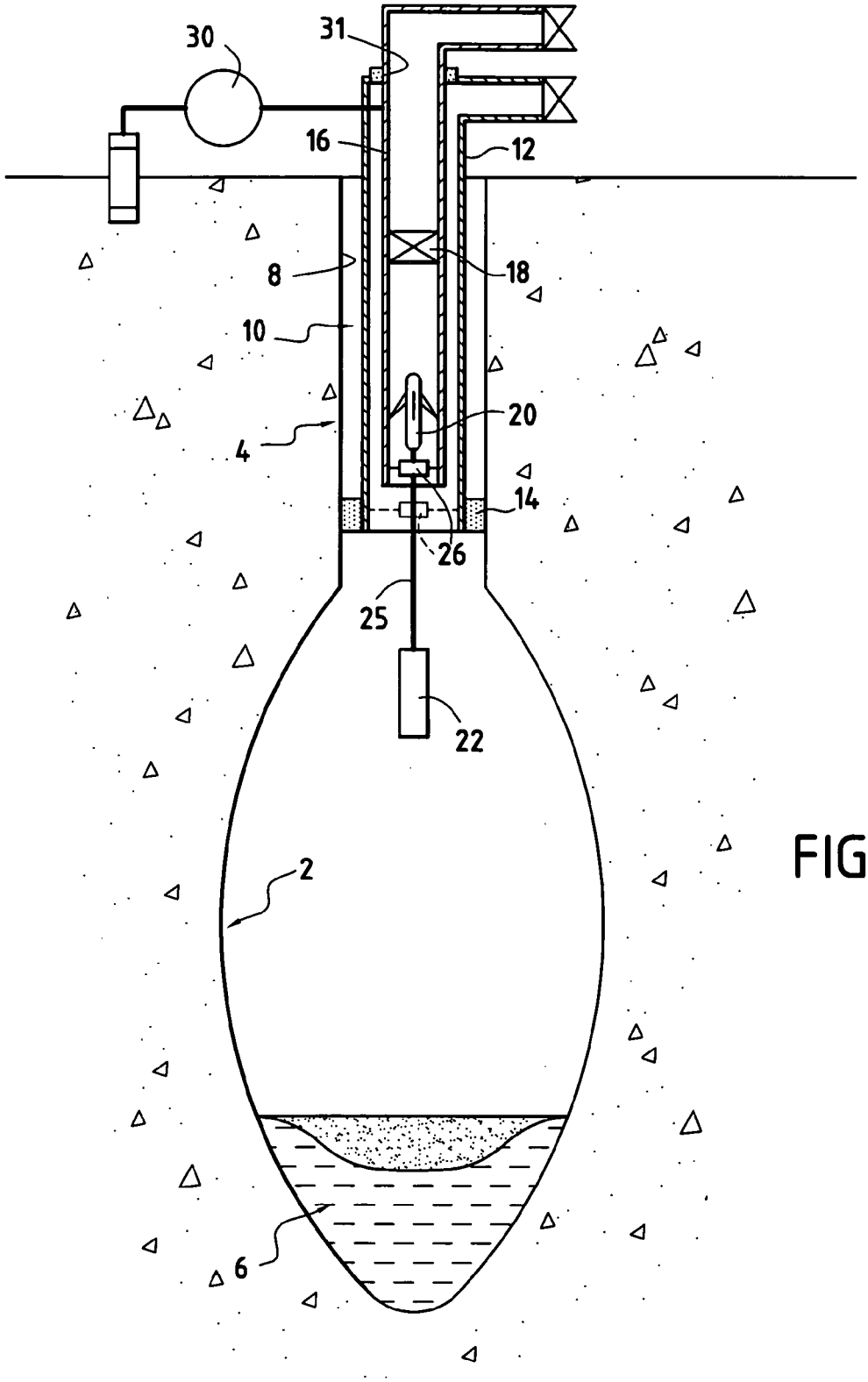
FIG. 3 shows a variant embodiment of apparatus implementing the method of the invention.

The connection cable 28 is not necessary if the measuring device 22 is connected directly to the transceiver 26. Similarly, the connection cable 24 may be avoided if the measuring device 22 is connected directly to the hanger system 20. In the embodiment of FIG. 3, a cable 25 is shown acting both as a mechanical connection cable 24 and as—the information transmission cable 28. When there is coupling with the bottom of the cavern, the length of the string of tools corresponds approximately to the distance between the level of salt water at the bottom of the cavern and the bottom of the production column, which length can be considerably more than one hundred meters.

With such apparatus for implementing the method of the invention, it is thus possible to perform coupling between the transceiver 26 and the structural means so as to enable information to be transmitted between the measuring device (s) and the surface. Such transmission of information takes place by the propagation of electromagnetic waves or mechanical waves as transmitted by the transceiver via the structural means.

When the transceiver transmits electromagnetic waves, the transceiver is advantageously in contact with the bottom of the cavern. The rock salt constituting the geological formation bed presents resistivity that is favorable to the propagation of such waves, i.e. of the order of several hundreds of ohms per meter. Under such circumstances, the transceiver modulates waves at frequencies that are suitable for propagating through geographical formation beds. For example, the waves used may have a frequency of less than 1000 hertz (Hz). The waves are also modulated as a function of the information to be transmitted and they are transmitted at a power of the order of a few watts (W). The coupling implemented between the transceiver and the geological formation bed is of an electrical nature. It is obtained by the presence of the conductive brine forming the deposit 6 which covers the bottom of the cavern. Nevertheless, when the volume of brine is not sufficient to guarantee good electrical coupling, it is possible to envisage adding an electrolyte to the bottom of the cavern. By way of example, it is possible to use various brines for constituting the liquid electrolyte (NaCl, KCl, etc.).

When the transceiver transmits mechanical waves (e.g. soundwaves or seismic waves), the coupling between the transceiver and the structural means is of a mechanical nature. The soundwaves are transmitted by a vibrating element 26 (of the piezoelectric type) placed at the bottom of the cavern or coupled to the bottom portion of the production column 16 or of the casing column 12. The vibrating element modulates waves having frequencies that are suitable for enabling them to propagate to the surface. The waves used in this way have a frequency lying in the range 10 Hz to 1 kilohertz (kHz). They are also modulated as a function of the information to be transmitted and they are transmitted at a power of the order of a few watts to a few kilowatts (kW).

The information conveyed by the electromagnetic or mechanical waves from the cavern to the surface is constituted by the measurements performed by the various logging tools fitted to the measuring devices 22. The waves carrying this information are picked up at the surface by a decoder 30 having one of its poles connected to the head 31 of the borehole and having its other pole driven into the ground at a sufficient distance from the head of the borehole. The decoder 30 serves to decode the waves transmitted by the transceiver in order to decipher the values of the measurements taken by the logging tool. The information may be transmitted to the surface continuously and in real time, or it may be transmitted discontinuously in packets of data stored in a memory of the measuring devices.

In the same manner, information can also be transmitted in the opposite direction, i.e. from the surface to the measuring devices. The decoder 30 is also suitable for transmitting electromagnetic or mechanical waves to the transceiver using an identical mode of propagation. Under such circumstances, the transmitted information can be used for controlling the measuring devices, e.g. in order to modify the frequency and the power at which waves are transmitted to the surface in order to conserve the battery fitted to the measuring devices to as great an extent as possible.

The step consisting in suspending the string of tools in the access borehole is described below in greater detail with reference to FIGS. 2A to 2E. In these figures, the production column 16 is provided at its top end with two removable anti-blowout shutters 32 that guarantee sealing between the cavern and the surface while the string of tools is being put into place. An airlock 34 that is also removable is positioned upstream of the two anti-blowout shutters 32.

In a first step (not shown in the figures), the airlock is disconnected from the production column in order to enable the transceiver to be put into place. The transceiver is fixed to a conductor cable wound on a drum (referenced 36 in FIGS. 2A to 2E) and it passes through the airlock.

Figure 2A:
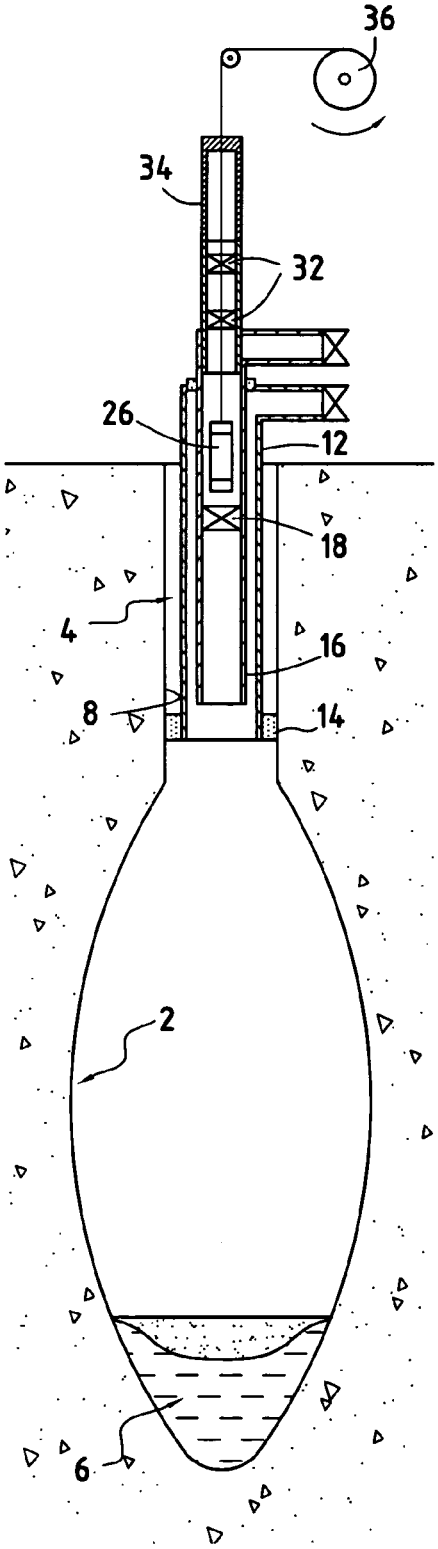
FIGS. 2A to 2E are diagrams showing different stages in implementing the method of the invention.

Once the transceiver 26 has been put into place and fixed to the conductor cable, the airlock 34 is reconnected to the production column. The anti-blowout shutters 32 can then be opened so as to allow the transceiver to be lowered (FIG. 2A). By actuating the drum 36, the transceiver is thus lowered down the production column 16 downstream from the safety valve 18 which is also open.

Figure 2B:
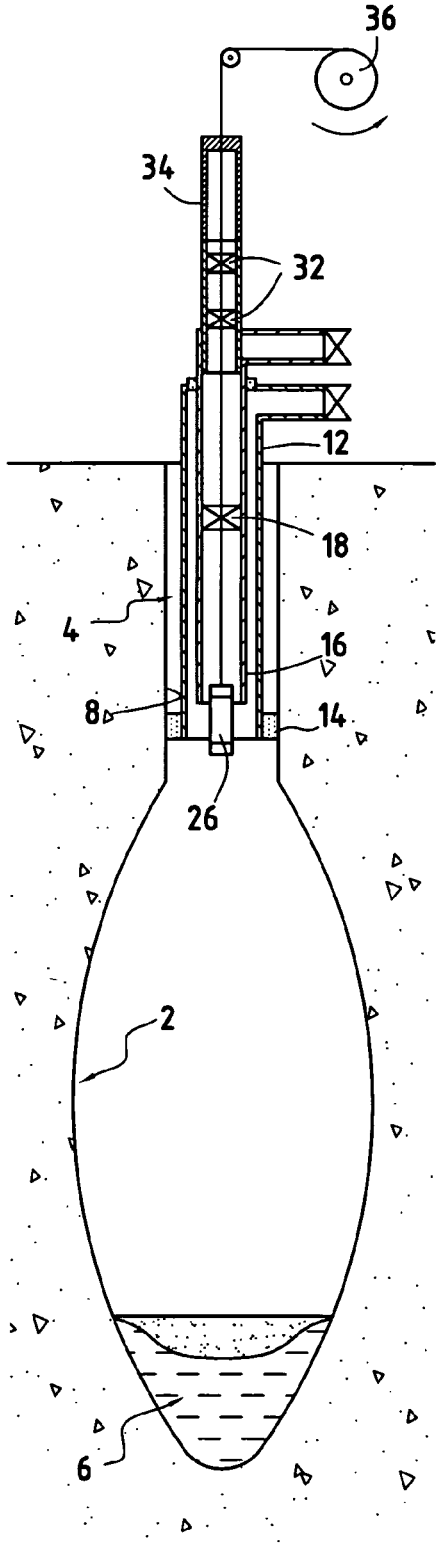

When the transceiver is judged to have reached the appropriate height, the anti-blowout shutters 32 are closed (FIG. 2B). It should be observed that the selected depth to which the transceiver is lowered has a direct effect on the height within the cavern of the measuring devices. This selection is performed in particular while taking account of the depth of the cavern. The effect of closing the anti-blowout shutters 32 is firstly to ensure there is sealing between the cavern and the airlock, and secondly to prevent the conductor cable from moving so as to keep the transceiver in suspension.

Figure 2C:
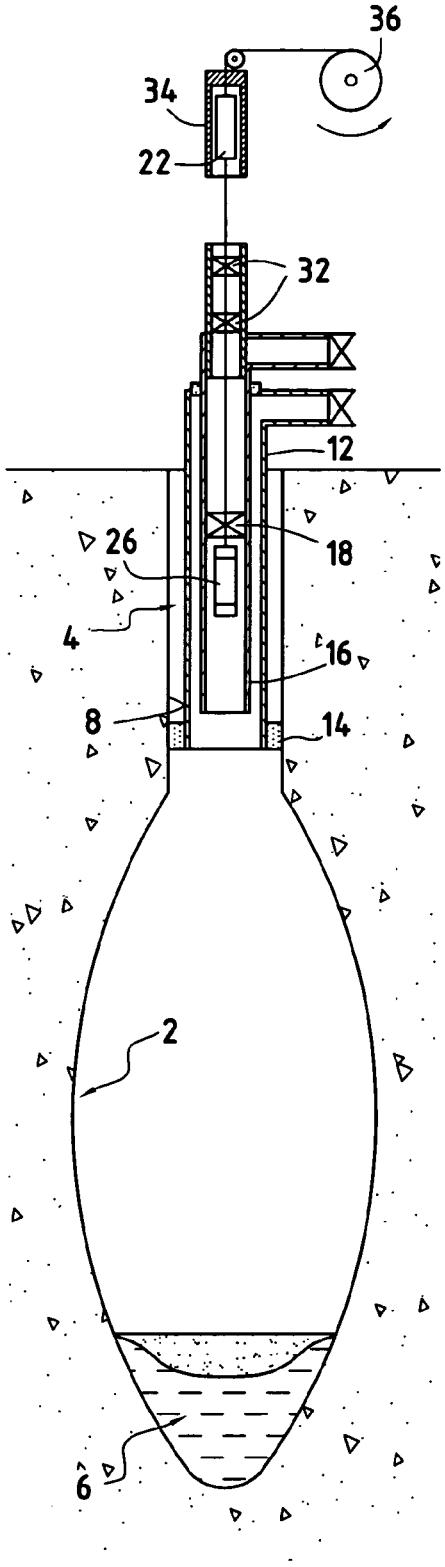
Figure 2D:
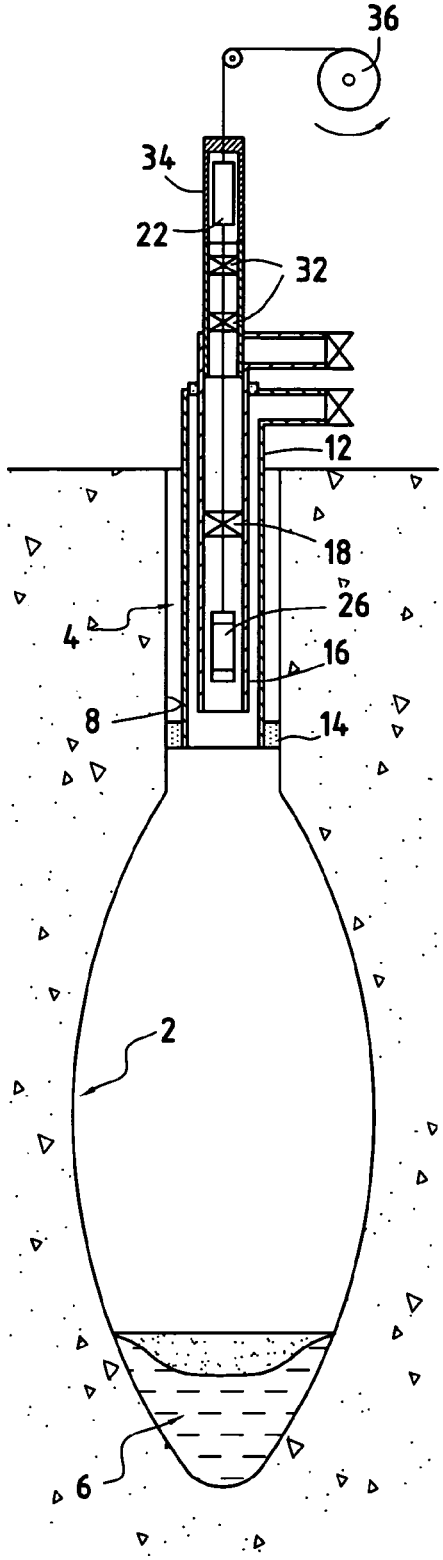

The following step consists in disconnecting the airlock 34 again in order to cut the conductor cable upstream from the anti-blowout shutters 32, while the transceiver 32 is kept in suspension in the production column because the shutters are closed. A measuring device 22 is then fixed to the free end of the conductor cable connected to the transceiver and is connected upstream to the cable wound on the drum 36. This measuring device is put into place in the disconnected airlock (FIG. 2C).

The airlock 34 is then reconnected to the production column 16 (FIG. 2D), the anti-blowout shutters 32 and the safety valve 18 are reopened, and the measuring device 22 is lowered downstream from the safety valve. These last two steps are repeated for each measuring device that is to be suspended in the cavern.

Figure 2E:
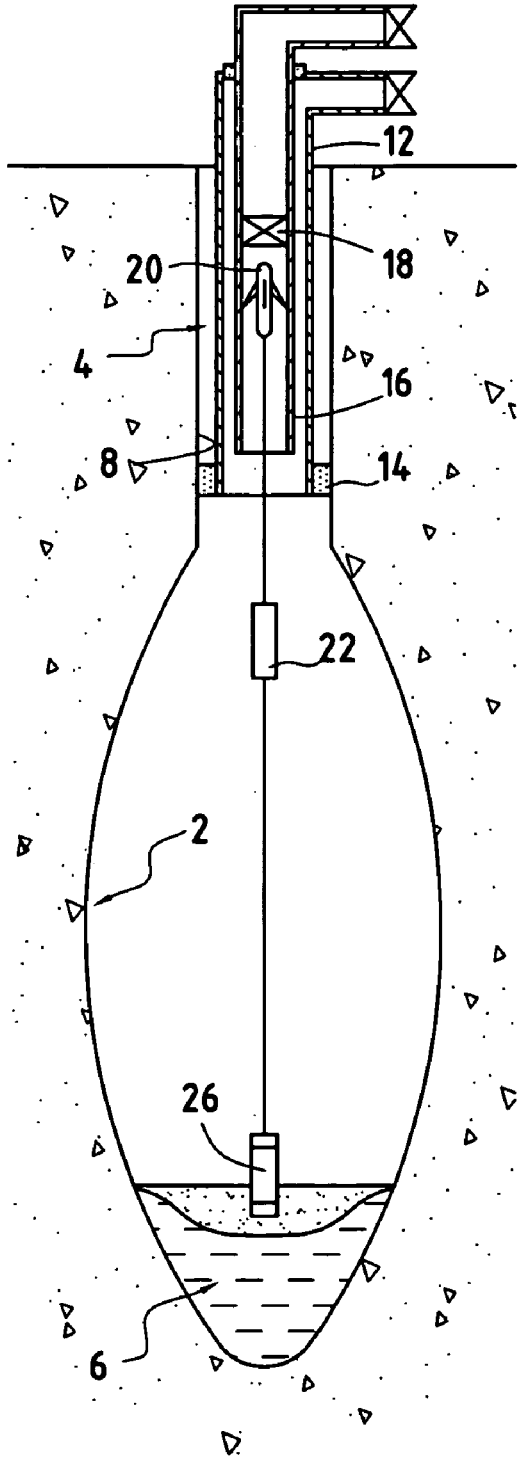

Once all of the measuring devices have been lowered, the hanger system is in turn lowered down the production column, acting in the same manner as for lowering the measuring devices. The hanger system is thus lowered downstream from the safety valve 18 to a height that enables the transceiver to come into contact with the stationary structural means linked to the cavern (the bottom of the cavern or the bottom portion of the column of casing or of the production column). Thereafter it is anchored in the inside walls of the production column. This anchoring is performed either by arms braced against the inside walls of the production column, or else by a seat integrated in the production column. The anti-blowout shutters 32 and the airlock 34 are then disconnected from the production column (FIG. 2E).

It should be observed that during these steps consisting in suspending the string of tools in the access borehole, the measuring device(s) should preferably be positioned outside the production column (i.e. they should be suspended in the cavern itself). It is important to avoid any electrical contact between the measuring devices and the inside walls of the production column. Nevertheless, if it appears to be necessary to position one or more of the measuring devices in the production column, an insulating coating may be used to cover the measuring devices. Alternatively, an insulating composite material may be used for making the housings of said devices.

Once the string of tools has been suspended in this way in the production column, it becomes possible to transmit information between the surface and the measuring devices by propagating electromagnetic or mechanical waves through the structural means.

The method of the invention enabling measurements to be performed at arbitrary height within the cavern while also allowing the borehole to be used in normal manner presents multiple advantages.

Most particularly, the method of the invention presents the advantage of making it possible while the cavern is being filled to track continuously and in real time the various physical parameters of the cavern (temperature, pressure, etc.) that determine the useful storage volume. It is thus possible to store a larger quantity of fluid, in particular of hydrocarbon gas, in complete safety.

Another advantage of continuously tracking the physical parameters inside the cavern in real time during the filling operation lies in the fact that it is possible to optimize the flow rate and thus the duration of injection.

According to another advantage of the method of the invention, the measurements are taken inside the cavern and not from the head of the boreholes, thus making it possible to obtain results that are much more reliable.

It is also possible to install and fit the apparatus for implementing the method in caverns that are already in operation without modifying the structure of the access borehole, thus making it possible to optimize operating performance and to generalize the use thereof without leading to expensive adaptations being implemented on the borehole. Such apparatus is also easy to remove.

It should also be observed that the method of the invention can be applied to various configurations of cavern. The example shown in the figures presents a configuration in which the production column is sectioned at the roof of the cavern. Nevertheless, it is possible to implement the method of the invention when the production column is not sectioned over its full height, i.e. when it extends below the roof of the cavern. In this type of configuration, the steps of putting the string of tools into place are identical to those descried above, except that the length between the hanger system and the transceiver is merely reduced.

What is claimed is:

1. A method of transmitting information between a salt-cavern and the surface of the ground, said cavern being drilled in geological formation beds and being connected to the surface via an access borehole cased at least in part by metal tubes and presenting at least one safety valve, said method consisting in:

suspending a string of tools from a hanger system positioned in the access borehole downstream from the safety valve and in electrical contact with the metal tubes, said string of tools including at least one measuring device connected to the hanger system via a first segment of conductor cable and an information transceiver operating by means of waves and connected to the measuring device via a second segment of conductor cable, said transceiver being positioned in such a manner as to be in contact with structural means linked to the cavern; and establishing coupling between the transceiver and the structural means, in order to enable information to be transmitted between the measuring device and the surface by propagating waves via the structural means.

2. A method according to claim 1, wherein the transceiver is in contact with the bottom of the cavern and operates by electromagnetic waves propagating through geological formation beds.

3. A method according to claim 2, wherein the coupling between the transceiver and the geological formation beds is electrical coupling that takes place by the presence of an electrolyte covering the bottom of the cavern.

4. A method according to claim 3, wherein the electrolyte is electrically conductive brine present continuously at the bottom of the cavern.

5. A method according to claim 3, wherein the electrolyte is added to the bottom of the cavern.

6. A method according to claim 1, wherein the transceiver operates by mechanical waves.

7. A method according to claim 6, wherein the coupling between the transceiver and the structural means is mechanical coupling that is performed by the presence of a vibrating element coupled to said structural means.

8. A method according to claim 7, wherein the vibrating element is coupled to the bottom of the cavern or to the metal tubes.

9. A method according to claim 1, wherein the measuring device is suspended at an arbitrary height in the cavern.

10. A method according to claim 1, wherein the measuring device is suspended in the access borehole.

11. A method according to claim 10, wherein the measuring device is provided with an insulating covering so as to avoid electrical contact with the metal walls of the access borehole.

12. A method according to claim 1, wherein the step consisting in suspension the string of tools consists in:

a) connecting a transceiver to a conductor cable;

b) opening a safety vale and anti-blowout shutters of the access borehole;

c) lowering the transceiver down the access borehole to downstream from the safety valve and the anti-blowout shutters;

d) closing the anti-blowout shutters of the access borehole so as to block the conductor cable in order to hold the transceiver in suspension and seal the borehole;

e) cutting the cable upstream from the anti-blowout shutters;

f) connecting at least one measuring device to the conductor cable;

g) repeating steps b) to e) for the measuring device;

h) connecting the hanger system to the conductor cable; and i) repeating steps b) to e) for the hanger system.

13. A device for implementing the method according to claim 1, the device comprising a hanger system, at least one measuring device connected to the hanger system by a first segment of conductor cable, and an information transceiver connected to the measuring device by a second segment of conductor cable.

* * * * *